US006604588B2

(12) United States Patent
Eyre et al.

(10) Patent No.: US 6,604,588 B2
(45) Date of Patent: Aug. 12, 2003

(54) GAGE TRIMMERS AND BIT INCORPORATING THE SAME

(75) Inventors: Ronald K. Eyre, Orem, UT (US); Stewart Middlemiss, Salt Lake City, UT (US); Lynn L. Belnap, Heber, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/966,149

(22) Filed: Sep. 28, 2001

(65) Prior Publication Data

US 2003/0062201 A1 Apr. 3, 2003

(51) Int. Cl.[7] ..... E21B 10/52

(52) U.S. Cl. ..... 175/374; 175/426; 175/428; 175/434

(58) Field of Search ..... 175/426, 374, 175/428, 430, 432, 434

(56) References Cited

U.S. PATENT DOCUMENTS

| | | | | | |
|---|---|---|---|---|---|
| 4,570,726 | A | * | 2/1986 | Hall | 175/426 |
| 4,861,350 | A | | 8/1989 | Phaal et al. | 51/307 |
| 4,954,139 | A | | 9/1990 | Cerutti | 51/293 |
| 5,119,714 | A | * | 6/1992 | Scott et al. | 76/108.2 |
| 5,120,327 | A | | 6/1992 | Dennis | 51/293 |
| 5,201,376 | A | * | 4/1993 | Williams | 175/374 |
| 5,287,936 | A | * | 2/1994 | Grimes et al. | 175/331 |
| 5,341,890 | A | * | 8/1994 | Cawthorne et al. | 175/374 |
| 5,435,403 | A | * | 7/1995 | Tibbitts | 175/432 |
| 5,469,927 | A | | 11/1995 | Griffin | 175/432 |
| 5,484,330 | A | | 1/1996 | Flood et al. | 451/540 |
| 5,486,137 | A | | 1/1996 | Flood et al. | 451/540 |
| 5,494,477 | A | | 2/1996 | Flood et al. | 451/540 |
| 5,566,779 | A | | 10/1996 | Dennis | 175/426 |
| 5,590,727 | A | | 1/1997 | Tank et al. | 175/374 |
| 5,590,728 | A | | 1/1997 | Matthias et al. | 175/432 |
| 5,598,750 | A | | 2/1997 | Griffin et al. | 76/108.2 |
| 5,605,199 | A | | 2/1997 | Newton | 175/432 |
| 5,655,612 | A | | 8/1997 | Grimes et al. | 175/401 |
| 5,711,702 | A | | 1/1998 | Devlin | 451/540 |
| 5,740,874 | A | * | 4/1998 | Matthias | 175/430 |
| 5,743,346 | A | | 4/1998 | Flood et al. | 175/420.2 |
| 5,788,001 | A | | 8/1998 | Matthias et al. | 175/432 |
| 5,816,347 | A | | 10/1998 | Dennis et al. | 175/432 |
| 5,829,541 | A | * | 11/1998 | Flood et al. | 175/426 |
| 5,881,830 | A | | 3/1999 | Cooley | 175/428 |
| 5,890,552 | A | | 4/1999 | Scott et al. | 175/426 |
| 5,967,250 | A | * | 10/1999 | Lund et al. | 175/428 |
| 5,971,087 | A | | 10/1999 | Chaves | 175/432 |
| 5,979,577 | A | | 11/1999 | Fielder | 175/431 |
| 6,000,483 | A | | 12/1999 | Jurewicz et al. | 175/428 |
| 6,009,963 | A | * | 1/2000 | Chaves et al. | 175/432 |
| 6,053,263 | A | * | 4/2000 | Meiners | 175/331 |
| 6,065,554 | A | * | 5/2000 | Taylor et al. | 175/430 |
| 6,068,071 | A | * | 5/2000 | Jurewicz | 175/432 |
| 6,082,223 | A | * | 7/2000 | Tibbitts | 76/108.2 |

(List continued on next page.)

FOREIGN PATENT DOCUMENTS

| | | | | |
|---|---|---|---|---|
| EP | 0295032 A2 | * | 12/1988 | E21B/10/52 |
| GB | 2274129 A | | 7/1994 | |
| GB | 2323398 A | | 9/1998 | |
| GB | 2337063 A | | 11/1999 | |

*Primary Examiner*—David Bagnell
*Assistant Examiner*—T. Shane Bomar
(74) *Attorney, Agent, or Firm*—Christie, Parker & Hale, LLP

(57) ABSTRACT

A gage trimmer and a bit incorporating such a gage trimmer are provided. The gage trimmer has an ultra hard material layer having a circumferential surface including a cylindrical portion and a flat surface for bearing against a circumferential wall of a hole drilled by the bit. The ultra hard material layer is formed over a substrate interface surface. The flat surface does not extend to the interface surface.

24 Claims, 6 Drawing Sheets

U.S. PATENT DOCUMENTS 6,135,219 A * 10/2000 Scott ..... 175/432
6,170,583 B1 * 1/2001 Boyce ..... 175/426
6,176,333 B1 * 1/2001 Doster ..... 175/428
6,196,341 B1 3/2001 Chaves ..... 175/432
6,202,770 B1 3/2001 Jurewicz et al. ..... 175/428
6,202,771 B1 3/2001 Scott et al. ..... 175/432
6,202,772 B1 3/2001 Eyre et al. ..... 175/432
6,290,008 B1 * 9/2001 Portwood et al. ..... 175/426
6,332,503 B1 * 12/2001 Pessier et al. ..... 175/336
6,405,814 B1 * 6/2002 Eyre et al. ..... 175/432
6,460,636 B1 * 10/2002 Yong et al. ..... 175/428
6,510,910 B2 * 1/2003 Eyre et al. ..... 175/430
6,513,608 B2 * 2/2003 Eyre et al. ..... 175/430
6,527,069 B1 * 3/2003 Meiners et al. ..... 175/432

* cited by examiner

FIG. 3
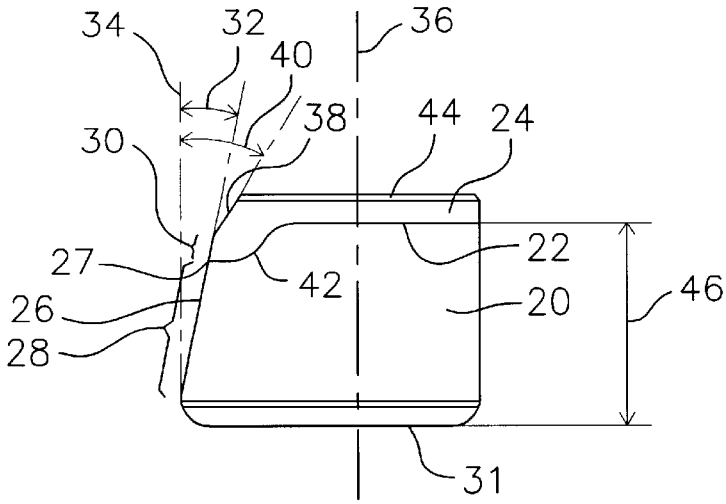
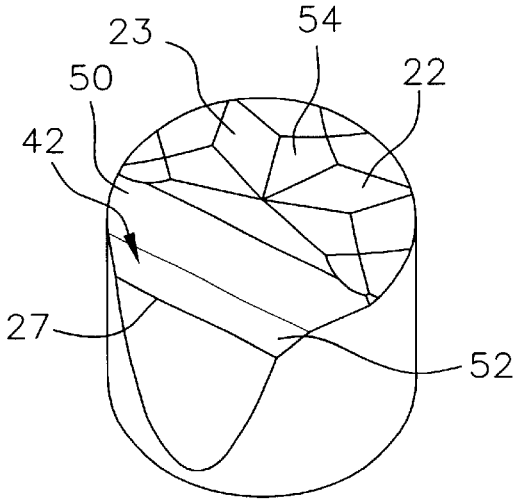
FIG. 4
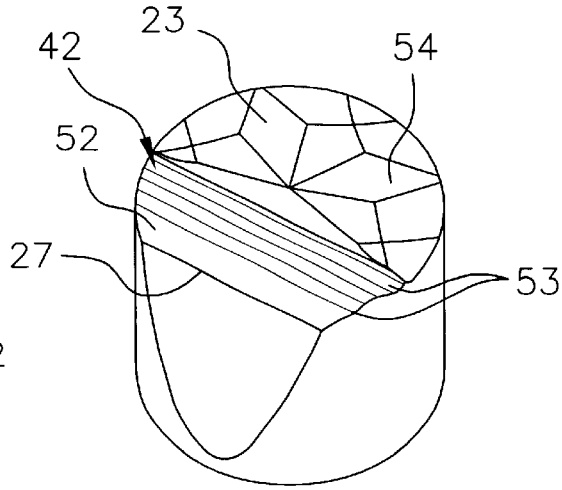
FIG. 5

GAGE TRIMMERS AND BIT INCORPORATING THE SAME

BACKGROUND OF THE INVENTION

This invention relates to gage trimmers and, more specifically, to gage trimmers that are mounted on a bit gage for maintaining accurate tolerances in the bit gage area while drilling a hole in earth formations and to a bit incorporating the same.

Current gage trimmers 2, also referred to as "preflat cutters", are manufactured from standard polycrystalline diamond cutters, which comprise a polycrystalline diamond layer ("PCD") 4 over a carbide substrate body 5, as for example shown in FIG. 1. These gage trimmers are formed by cutting off a portion of a PCD cutter at an angle to the cutter central axis. This is typically accomplished by grinding to form a flat surface 6 extending across the cutter ultra hard material layer and a flat surface 7 across the body of the cutter as for example shown in FIG. 1. The two flat surfaces are typically angled relative to each other. The flat surface 6 formed on the ultra hard material layer is referred to herein as the "ultra hard material flat" or "ultra hard material preflat area". The ultra hard material flat extends from the upper surface of the PCD layer to the interface of the PCD layer with the substrate.

The gage trimmers 2 are mounted in the gage area 12 of a bit 14, i.e., the circumferential side area of the bit defining the bit gage (FIG. 2). The gage trimmers are typically mounted above all bit cutters and with their ultra hard material flat 6 parallel to the longitudinal axis of the bit, and thus parallel to the drill hole or bore wall 16 as for example shown in FIG. 1. Consequently the entire ultra hard material flat 6 is subject to engagement with the wall 16 of the drilled hole. For descriptive purposes the ultra hard material flat is also referred to herein as the "critical flat." The flat 7 formed on the gage trimmer body provides clearance between the trimmer body and the bore wall 16.

The critical flat 6 serves as a bearing against the drilled hole wall to prevent the wear of the bit body by the hole wall. Consequently, the gage trimmers do not wear as much as standard PCD cutters because they bear against and do not cut the bore wall. However, it is important that the gage trimmers do not wear significantly, otherwise the bit body can wear to a point that it is under gage.

One of the more significant problems with gage trimmers is that during drilling operations their PCD/carbide interface is exposed to significant shear loads. These loads are due to contact with hole walls by the critical flat during cutting. The gage trimmers are operated at an effective 0° rake angle without any or with minimal clearance behind the ultra hard material, as for example shown in FIG. 1. Thus, in contrast with the normal full-round shear cutters, which are inserted into the bit at a rake angle, the gage trimmer interface between the PCD layer and the carbide body of a gage trimmer is subject to direct shear loading.

The interface region is often the weakest part of the gage trimmer. Consequently the direct shear loading on the interface region results in early failure of the gage trimmer. Furthermore, as the gage trimmer wears with time, the interface is exposed to abrasive wear and impact due to contact with the bore wall, which often leads to erosion of the carbide substrate, resulting in failure of the gage trimmer. Failure of the gage trimmers ultimately results in failure to keep the drill hole in gage.

SUMMARY OF THE INVENTION

A gage trimmer and a bit incorporating such a gage trimmer is provided. In an exemplary embodiment the gage trimmer comprises a body having a central longitudinal axis, a base and an end face, the body having a circumferential surface comprising a generally cylindrical portion and a relatively flat portion formed along a first plane. An ultra hard material layer is formed over the end face having a circumferential surface comprising a generally cylindrical portion and a relatively first flat portion formed along a first plane for bearing against a circumferential wall of a hole drilled by the bit. The first plane is inclined toward a diameter of the cutting layer in a direction away from the interface surface at an angle relative to a second plane parallel to a third plane aligned with said central longitudinal axis. The flat portion does not extend to the interface surface. Furthermore, in the exemplary embodiment, the ultra hard material layer thickness is greater at the circumferential flat portion than at the circumferential cylindrical portion of the ultra hard material layer.

BRIEF DESCRIPTION OF THE DRAWINGS

FIG. 3 is a cross-sectional view of an exemplary embodiment gage trimmer of the present invention.

FIG. 4 is a perspective view of the body of another exemplary embodiment gage trimmer of the present invention with the ultra hard material layer removed.

FIG. 5 is a perspective view of the body of another exemplary embodiment gage trimmer of the present invention with the ultra hard material layer removed.

DETAILED DESCRIPTION OF THE INVENTION

Figure 1:
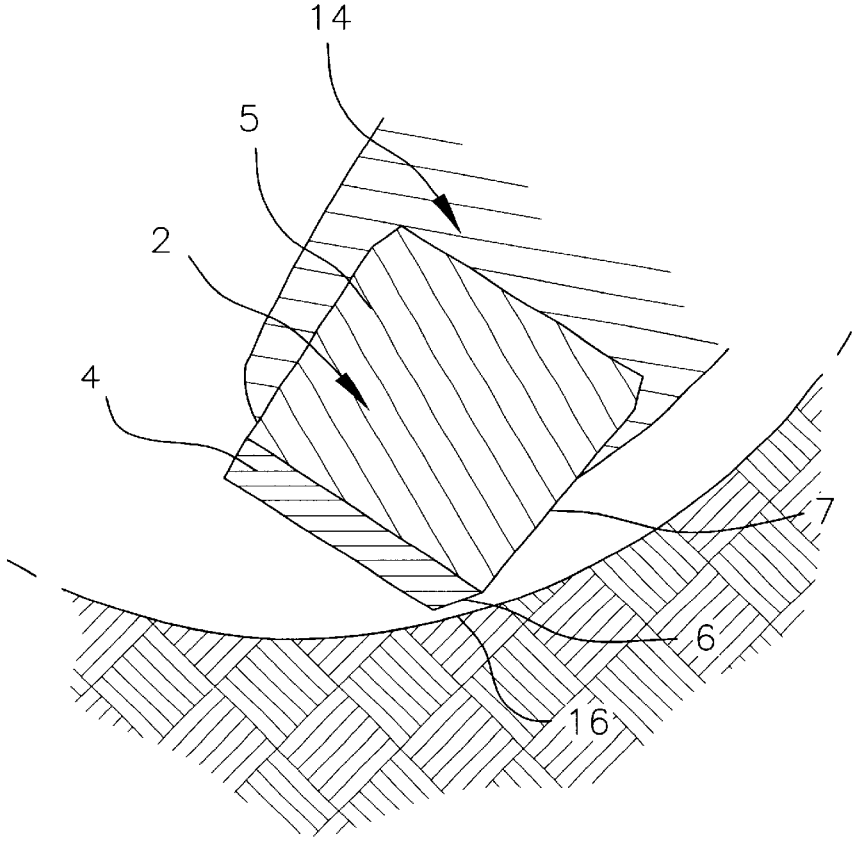
FIG. 1 PRIOR ART
FIG. 1 is a partial cross-sectional view of a prior art gage trimmer mounted on a bit body and bearing against the circumference of a hole drilled by the bit.
Figure 2:
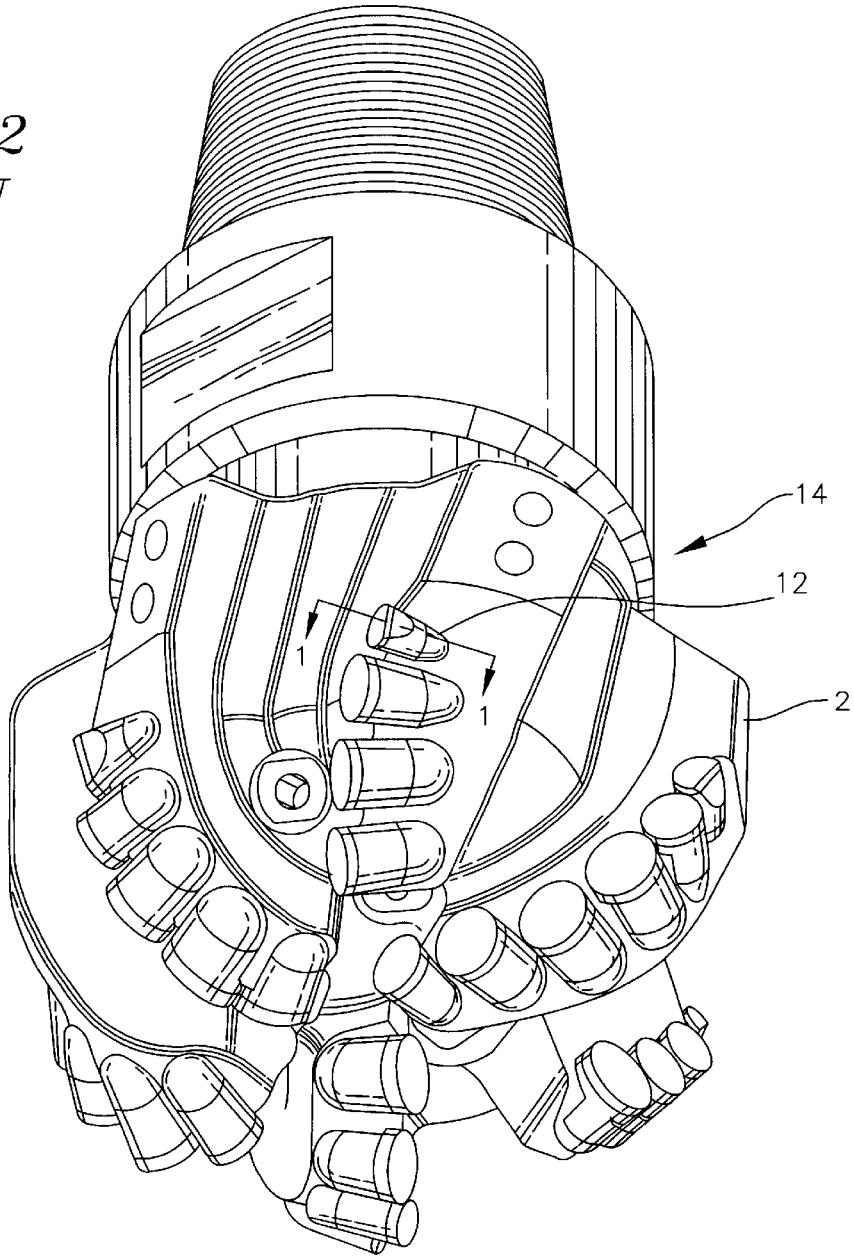
FIG. 2 PRIOR ART
FIG. 2 is a perspective view of a bit incorporating the gage trimmer shown in FIG. 1.

The gage trimmers of the present invention have their interface between their ultra hard material layer and their substrate body offset from the critical preflat cutting surface, thereby protecting the interface from the direct shear loads and also shielding the carbide substrate from abrasive wear. In other words the critical flat does not extend to the interface between the ultra hard material layer and the substrate. It should be noted that the terms "upper" and "lower" are used herein for descriptive purposes to describe relative positions and not exact positions.

In an exemplary embodiment shown in FIG. 3, a gage trimmer of the present invention comprises a generally cylindrical body 20 or substrate typically made from tungsten carbide and having an end face 22, over which is formed an ultra hard material layer 24, such as a polycrystalline diamond (PCD) or polycrystalline cubic boron nitride (PCBN) layer. The body and ultra hard material layer are generally cylindrical, having a flattened region defined thereon. More specifically, a flat surface 26 is formed on the body and extends to a portion of the ultra hard material layer, defining a body flat surface 28 and a ultra hard material layer first flat surface 30. The flat surface 26 extends at an angle 32 from a plane 34 parallel to the longitudinal central axis 36 of the gage trimmer in a direction toward the longitudinal central axis. In the exemplary embodiment shown in FIG. 3, the flat surface 26 extends from proximate a lower surface 31 of the body toward an upper surface of the body and is inclined at an angle 32 relative to a plane 34 (referred to herein for convenience as the "tangent plane") parallel to the longitudinal central axis 36 of the gage trimmer and tangent the lower portion of the body at an angle of about 1.5°±0.5°.

A second flat surface 38 is formed on the ultra hard material layer, extending from the first flat surface to the upper surface 44 of the ultra hard material layer. The second flat surface is inclined at an angle 40 relative to the tangent plane 34 at an angle greater than the angle of inclination 32 of the first flat surface. In the exemplary embodiment shown in FIG. 3, the second flat surface is inclined at an angle 40 relative to the tangent plane of about 30°±2°. The second cutting surface is the "critical flat" of the gage trimmer since it is the flat that will bear against the hole during normal drilling operations.

A main depression 42 is formed on the substrate end face extending to the flat surface 26 of the substrate. The intersection between the flat surface 26 and the substrate end face define a "substrate critical edge" 27. The main depression spans a portion of the end face 22. In the exemplary embodiment shown in FIG. 3, the main depression spans less than 50% of the surface area of the end face. The ultra hard material layer 24 is formed over the end face with main depression such that the thickness of the ultra hard material layer is greatest immediately above the main depression 42. In the exemplary embodiment shown in FIG. 3, the ultra hard material layer 24 has a relatively flat upper surface 44. With this embodiment, because the interface is depressed, the critical flat 38 does not extend all the way to the interface surface 22 as with prior art gage trimmers. As such, the interface surface 22 is removed from the direct shear stresses generated during drilling operations. Furthermore, the critical flat 38 can wear substantially prior to exposing the substrate. Furthermore, wear of the critical flat is reduced since a larger area of the ultra hard material layer has to be worn as compared with conventional gage trimmers for wear of the critical flat to occur. For example, a portion of the first flat 30 of the ultra hard material layer must also be worn for wear on the critical flat to progress.

Moreover, by selectively increasing the thickness of the diamond at and proximate the critical flat, applicants have discovered that they can increase the local thickness of the ultra hard material at and proximate the critical flat up to about the 0.200 inches without subjecting the ultra hard material layer to problems typically associated with increasing the thickness of ultra hard material, such as delamination from the substrate and spalling. For example, with prior art gage trimmers, when the thickness of the ultra hard material layer is increased to about over 0.12 inches, the gage trimmer subject to early delamination and spalling of the ultra hard material layer.

The increase in the thickness of the ultra hard material layer at and proximate the critical flat, increases the impact strength and the wear resistance of the ultra hard material layer. Furthermore, by not increasing the ultra hard material layer throughout the end face of the gage trimmer, the length 46 of the body of the gage trimmer that is brazed to the bit when the gage trimmer is mounted on the bit remains unchanged in relation to prior art gage trimmers. Consequently, the exemplary gage provides for an increase in impact strength and wear resistance without decreasing the gage trimmers brazing surface. Thus, the braze strength is not compromised. Moreover, with the gage trimmers of the present invention, the surface area of the body that is brazed can be increased as necessary by decreasing the thickness of the ultra hard material proximate to the brazable surface of the gage trimmer without effecting the overall dimensions of the gage trimmer.

Figure 6:
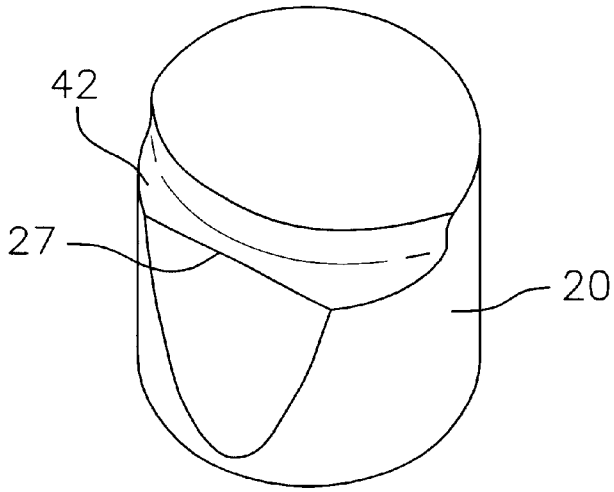
FIG. 6 is a perspective view of the body of yet another exemplary embodiment gage trimmer of the present invention with the ultra hard material layer removed.
Figure 7:
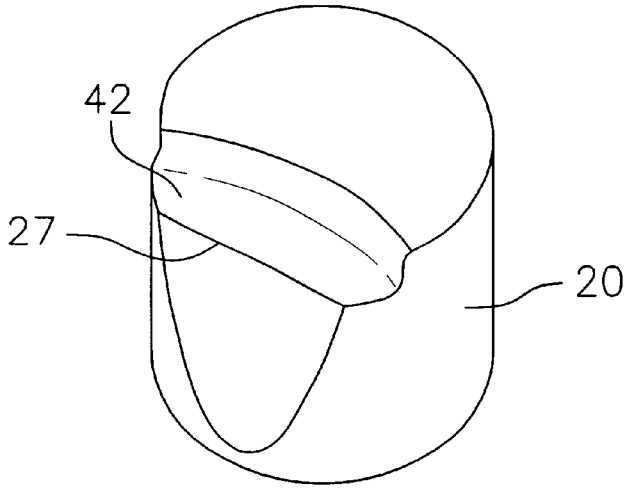
FIG. 7 is a perspective view of the body of another exemplary embodiment gage trimmer of the present invention with the ultra hard material layer removed.

In another exemplary embodiment gage, the main depression 42 formed on the body 20, as for example shown in FIG. 4 is formed chordwise across the end face 22 of the body. In the exemplary embodiment, the main depression is a step having a sloped riser surface 50 from which extends a lower tread surface 52. The tread surface 52 extends to the substrate critical edge 27. Instead of a riser surface 50 steps 53 may be formed extending to the lower tread surface 52, as for example shown in FIG. 5. In yet another exemplary embodiment, the main depression 42 is arcuate as for example shown in FIG. 6 or may be elliptical as for example shown in FIG. 7.

In any of the exemplary embodiments, by forming steps 53 or by making the sloped riser surface 52 non-planar, the residual stress distribution generated at the interface between the ultra hard material layer 24 and the body 20 is reduced. To further reduce the residual stresses of the non-depressed portion 23 of the end face 22, the non-depressed portion may also be made non-planar as for example by having abutting smaller depressions 54 formed thereon as shown in FIGS. 4 and 5. In yet a further exemplary embodiment, the main depression lower surface, as for example the tread surface or the entire main depression surface 52 may also be made non-planar.

Generally speaking the process for making a trimmer employs a body of cemented tungsten carbide where the tungsten carbide particles are cemented together with cobalt. The carbide body is placed adjacent to a layer of diamond (or cubic boron nitride) particles and the combination is subjected to high temperature at a pressure where diamond is thermodynamically stable. This results in recrystallization and formation of a polycrystalline diamond (or polycrystalline cubic boron nitride) layer on the surface of the cemented tungsten carbide. The layer of diamond (or cubic boron nitride) crystals may include tungsten carbide particles and/or small amounts of cobalt. Cobalt promotes the formation of polycrystalline diamond and if not present in the layer of diamond, cobalt will infiltrate from the cemented tungsten carbide substrate.

Figure 8A:
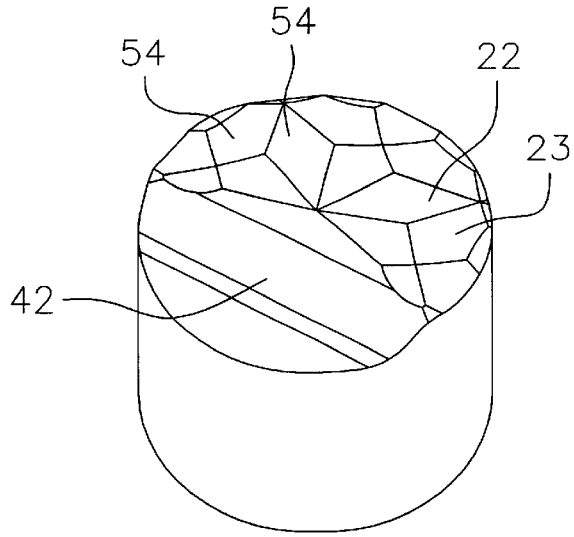
FIG. 8A is a perspective view of the body of an exemplary embodiment gage trimmer of the present invention prior to being machined to size with the ultra hard material layer removed.

There are a few methods for forming the desired interface between the body and the ultra hard material layer. One method requires presintering the body 20. The main depression 42 and any other depressions or irregularities 54 are then milled or EDM-sunk into the end face of the presintered body (FIG. 8A). The ultra hard material layer is then laid over the transition layer. The ultra hard material may be laid in powder form or in sheet form.

Other methods of forming the desired interface commonly require that the main depression and any other depressions or irregularities are formed on the body end face during the body pre-sintering process. Typically the body is formed from a powder tungsten carbide material. The main depression and any other necessary depressions or irregularities are pressed on a portion of the powder substrate that would form the end face while the body is being pre-sintered.

Figure 8B:
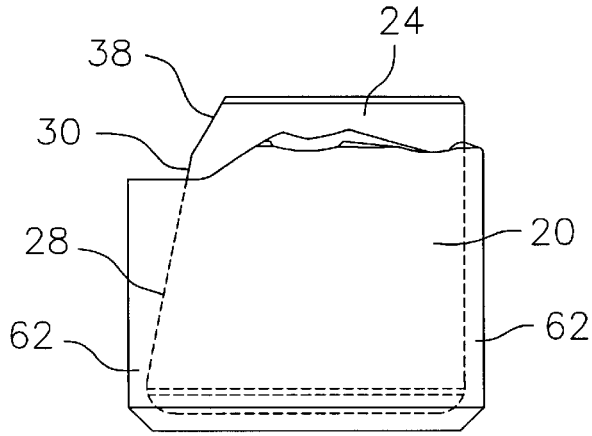
FIG. 8B is an end view of an exemplary embodiment gage trimmer of the present invention formed using the body shown in FIG. 8A and depicting the areas of machining.

Once the body with ultra hard material layer is formed a circumferential portion 62 of the gage trimmer is removed by grinding, machining or EDM (FIG. 8B). The flat surface 28 is then formed on the body and the flat surface 30 and critical surface 38 are formed on the ultra hard material layer either by machining, grinding or EDM.

Figure 9A:
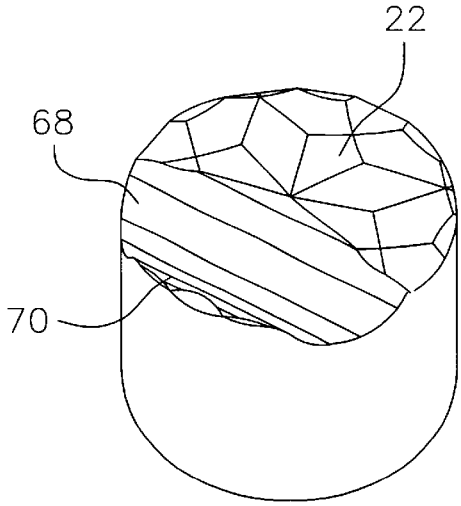
FIG. 9A is a perspective view of another exemplary embodiment gage trimmer body prior to being machined with the ultra hard material layer removed.
Figure 9B:
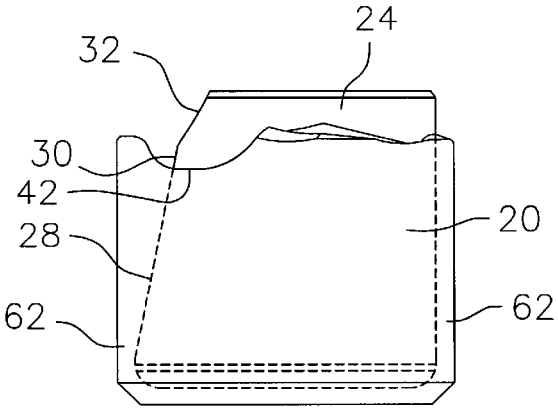
FIG. 9B is a end view of an exemplary embodiment gage trimmer formed with the body shown in FIG. 9A and depicting the areas of machining.

In another exemplary embodiment, instead of forming the depression 42 on the body end face 22 extending to the body circumference, i.e., the substrate critical edge as shown for example in FIG. 8A, a channel 68 is formed across the end face 22 having one of its lengthwise sides 70 proximate the circumference of the body, as for example shown in FIG. 9A. The ultra hard material layer is then formed over the end face. The channel allows for better packing of the ultra hard material when forming the ultra hard material layer. After the gage trimmer is formed with the channel occupied by the ultra hard material layer, the trimmer is cut and the flat surfaces 28, 30 and 32 are formed by removing a portion of the channel including the side 70 so as to define the depression 42 shown in FIG. 9B.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A bit comprising:

a gage row cavity; and a gage trimmer fitted in the gage row cavity and comprising, a body having a central longitudinal axis, a base and an end face, the body having a circumferential surface comprising a generally cylindrical portion and a relatively flat portion formed along a first plane, a depression formed on the end face extending to said first plane, and an ultra hard material layer formed over the end face having a circumferential surface comprising a generally cylindrical portion, a relatively first flat portion formed along the first plane and a second relative flat portion extending from the first portion and formed along a second plane, wherein the first plane is inclined toward a diameter of the body in a direction away from the base and toward the end face at a first angle relative to a third plane parallel to a fourth plane aligned with said central longitudinal axis, and wherein the second plane is inclined relative to the first plane at a second angle relative to the third plane greater than the first angle.

2. A bit as recited in claim 1 wherein the ultra hard material layer has a thickness that is greater at the second relative flat portion than at the cylindrical portion.

3. A bit as recited in claim 2 wherein the depression defines a step extending to the first plane.

4. A bit as recited in claim 1 wherein the depression comprises a plurality of steps decreasing in height as measured from the base in a direction toward the first plane.

5. A bit as recited in claim 1 wherein the depression has a non-uniform surface.

6. A bit as recited in claim 1 wherein a portion of the end face adjacent the depression comprises a non-uniform portion.

7. A bit comprising:

a gage row cavity;

a gage trimmer fitted in the gage row cavity and comprising, a body having a central longitudinal axis, a base and an end face, the body having a circumferential surface comprising a generally cylindrical portion and a relatively flat portion formed along a first plane, a depression formed on the end face extending to said first plane, and an ultra hard material layer formed over the end face having a circumferential surface comprising a generally cylindrical portion and a relatively flat portion for bearing against a circumferential wall of a hole drilled by said bit.

8. A bit as recited in claim 7 wherein the ultra hard material flat portion is formed along the first plane.

9. A bit as recited in claim 7 wherein the ultra hard material flat portion is formed along a second plane, wherein the first plane is inclined toward a diameter of the body in a direction away from the base and toward the end face at a first angle relative to a third plane parallel to a fourth plane aligned with said central longitudinal axis, and wherein the second plane is inclined relative to the first plane at a second angle relative to the third plane greater than the first angle.

10. A bit as recited in claim 7 wherein the depression defines a step extending to the first plane.

11. A bit as recited in claim 7 wherein the depression comprises a plurality of steps decreasing in height as measured from the base in a direction toward the first plane.

12. A bit as recited in claim 7 wherein the depression has a non-uniform surface.

13. A bit as recited in claim 7 wherein a portion of the end face adjacent the depression comprises a non-uniform portion.

14. A gage trimmer comprising:

a body having a central longitudinal axis, a base and an end face, the body having a circumferential surface comprising a generally cylindrical portion and a relatively flat portion formed along a first plane;

a depression formed on the end face extending to said first plane; and an ultra hard material layer formed over the end face having a circumferential surface comprising a generally cylindrical portion, a relatively first flat portion formed along the first plane and a second relative flat portion extending from the first portion and formed along a second plane, wherein the first plane is inclined toward a diameter of the body in a direction away from the base and toward the end face at a first angle relative to a third plane parallel to a fourth plane aligned with said central longitudinal axis, and wherein the second plane is inclined relative to the first plane at a second angle relative to the third plane greater than the first angle.

15. A gage trimmer as recited in claim 14 wherein the ultra hard material layer has a thickness that is greater at the second relative flat portion than at the cylindrical portion.

16. A gage trimmer as recited in claim 14 wherein the depression defines a step extending to the first plane.

17. A gage trimmer as recited in claim 14 wherein the depression has a non-uniform surface.

18. A gage trimmer as recited in claim 14 wherein a portion of the end face adjacent the depression is non-uniform.

19. A gage trimmer comprising:

a body having a central longitudinal axis, a base and an end face, the body having a circumferential surface comprising a generally cylindrical portion and a relatively flat portion formed along a first plane;

a depression formed on the end face extending to said first plane; and an ultra hard material layer formed over the end face having a circumferential surface comprising a generally cylindrical portion and a relatively flat portion.

20. A gage trimmer as recited in claim 19 wherein the ultra hard material flat portion is formed along the first plane.

21. A gage trimmer as recited in claim 19 wherein the ultra hard material flat portion is formed along a second plane, wherein the first plane is inclined toward a diameter of the body in a direction away from the base and toward the end face at a first angle relative to a third plane parallel to a fourth plane aligned with said central longitudinal axis, and wherein the second plane is inclined relative to the first plane at a second angle relative to the third plane greater than the first angle.

22. A gage trimmer as recited in claim 19 wherein the depression defines a step extending to the first plane.

23. A gage trimmer as recited in claim 19 wherein the depression has a non-uniform surface.

24. A gage trimmer as recited in claim 19 wherein a portion of the end face adjacent the depression is non-uniform.

* * * * *